United States Patent [19]

Golden

[11] 4,015,748

[45] Apr. 5, 1977

[54] DRAPERY PLEATING AND FINISHING MACHINE

[76] Inventor: Steven T. Golden, 822 Teague Drive, Santa Paula, Calif. 93060

[22] Filed: May 26, 1976

[21] Appl. No.: 690,066

[52] U.S. Cl. ..... 223/32

[51] Int. Cl.[2] ..... A41H 43/00; D05B 35/08

[58] Field of Search ..... 223/28–34

[56] References Cited

UNITED STATES PATENTS

| | | | |
|---|---|---|---|
| 3,295,731 | 1/1967 | Klint | 223/32 |
| 3,424,356 | 1/1969 | Getchell et al. | 223/32 |
| 3,613,968 | 10/1971 | Kirche | 223/32 |
| 3,806,006 | 4/1974 | Golden et al. | 223/32 |

*Primary Examiner*—G. V. Larkin
*Attorney, Agent, or Firm*—Poms, Smith, Lande & Glenny

[57] ABSTRACT

An apparatus is provided for forming or restoring the pleats of draperies which have been newly made or freshly dry cleaned. The drape or drapes are supported from a horizontally extending hanger bar which in turn is vertically movable on an upstanding frame. An improved horizontally mounted pleater bar assembly is also vertically movable on the frame and includes a stationary bar mounted on the frame having a plurality of spaced plates or fingers extending generally normal to the drapes and a movable bar carrying a plurality of spaced, flexible fingers, which movable bar is movable from a position away from the drape or drapes to a position whereby the fingers interleave with the plates with the drapery pleats passing about the fingers and plates. A releasable lock is provided for quickly and easily locking approximately 90% of the drapes between the plates and fingers. The fingers include means for preventing bulges from forming in the drapes when so locked and optional means may be provided on the stationary bar for locking approximately the remaining 10% of the drapes. The drapery fabric may then be stretched and finished as disclosed in U.S. Pat. No. 3,806,006.

22 Claims, 7 Drawing Figures

DRAPERY PLEATING AND FINISHING MACHINE

BACKGROUND OF THE INVENTION

1. Field of the Invention

The invention relates to drapery pleating and finishing machines; and, more particularly, to an improved pleater bar for use in a machine such as that disclosed in my U.S. Pat. No. 3,806,006.

2. Description of the Prior Art

Various types of machines are known in the art for reshaping or finishing drapes after they have been cleaned, such as by dry cleaning or newly made. A complete review of the prior art in this area appears in my U.S. Pat. No. 3,806,006. In this patent, a machine is disclosed wherein drape or drapes are supported from a horizontally extending hanger bar which in turn is vertically movable on an upstanding frame. A horizontally mounted pleater bar assembly is also vertically movable on the upstanding frame. This assembly includes a pair of complementary pleater bars individually rotatable so as to facilitate the tucking of the drapery pleats into pleat forming fingers of the pleater bar assembly. Once the fabric has been properly positioned with respect to the pleater bar fingers, these fingers are movable into an interleaved condition in which the drapery may be drawn past these fingers so as to comb out the pleats. One of the pleater bars carries a double set of nested fingers which are axially displaceable along the pleater bar to lock or clamp the fabric against confronting portions of adjacent fingers of the other pleater bar assembly. This provides for effectively and neatly camping a lower hem portion of the drapery for stretching the fabric to a desired length. This stretching operation is effected by a tension spring placed in operation by a foot operated lock and release bar assembly and by adjustable stretch stops which limit the stretching of the drapery under the spring tension. Upon finishing the drape, its upper hem is quickly and easily released from drapery hooks carried by the hanger bar by a manually rotatable release bar assembly.

By use of the fingers of the pleater bar assembly, pleats are formed in the drape or drapes. However, it is desirable to eliminate any bulges of drapery material that may occur during the stretching operation. Such bulging may occur when the drapery fabric is clamped by the nested fingers.

SUMMARY OF THE INVENTION

It is an object of this invention to provide an improved drapery pleating and finishing machine.

It is a further object of this invention to provide an improved pleater bar assembly for use in a drapery pleating and finishing machine, such as that disclosed in U.S. Pat. No. 3,806,006.

It is still another object of this invention to provide an improved pleater bar assembly which locks in place over 90% of the hem of a drape within the assembly without bulding of the same.

It is still further an object of this invention to provide means for locking virtually 100% of the hem of the drape within a pleater bar assembly without bulging of the same.

It is a further object of this invention to provide an improved pleater bar having a lock for locking in place the hem of a drape which lock is relatively inexpensive, quickly releasable and easy to operate.

These and other objects are preferably accomplished by providing a horizontally extending hanger bar which in turn is vertically movable on an upstanding frame. An improved horizontally mounted pleater bar assembly is also vertically movable on the frame and includes a stationary bar mounted on the frame having a plurality of spaced plates or fingers extending generally normal to the drapes and a movable bar carrying a plurality of spaced, flexible fingers which movable bar is movable from a position away from the drape or drapes to a position whereby the fingers interleave with the plates with the drapery pleats passing about the fingers and plates. A releasable lock is provided for quickly and easily locking approximately 90% of the drapes between the plates and fingers. The fingers include means for preventing bulges from forming in the drapes when so locked and optional means may be provided on the stationary bar for locking approximately the remaining 10% of the drapes. The drapery fabric may then be stretched and finished as disclosed in U.S. Pat. No. 3,806,006.

DESCRIPTION OF THE PREFERRED EMBODIMENT

Figure 1:
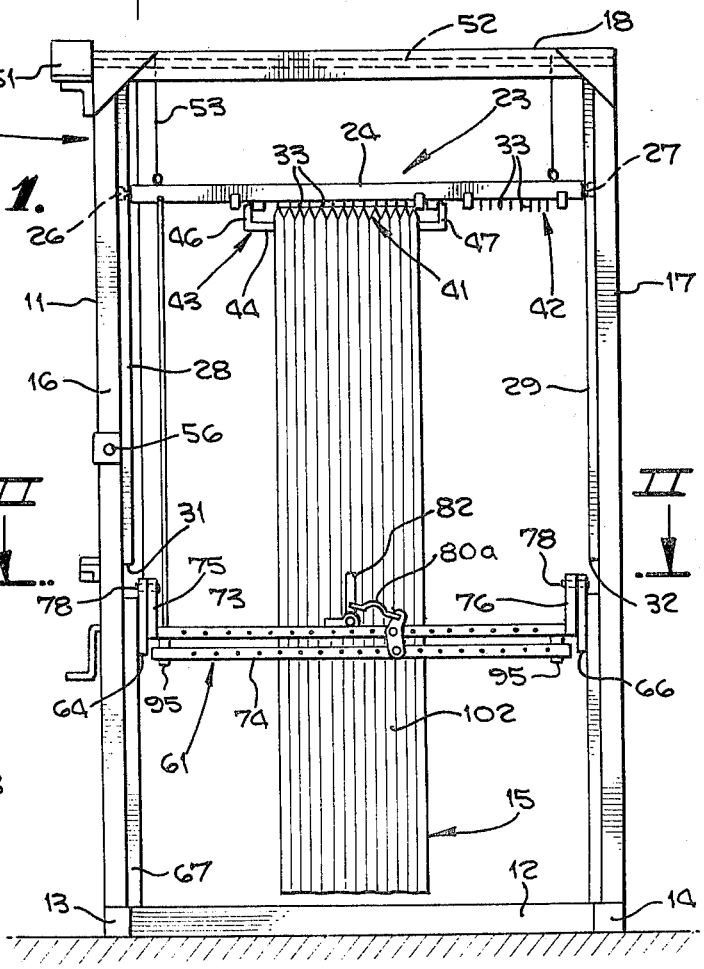
FIG. 1 is a front elevation view of a drapery pleating and finishing machine similar to that disclosed in my U.S. Pat. No. 3,806,006 but showing my improved pleater bar assembly thereon.

Referring now to FIG. 1, a drapery pleating and finishing machine 10 is shown essentially similar, save for minor differences where noted, to the machine disclosed and claimed in U.S. Pat. No. 3,806,006, the teachings of which are incorporated herein by reference. Reference should be made to my aforementioned patent for a complete understanding of the invention. However, in the instant invention, as will be discussed, an improved pleater bar assembly is shown.

Thus, machine 10 may be used for pleating and sizing drapery. It is primarily used for finishing draperies that have been laundered or dry cleaned but it may also be used for pleating, finising and sizing newly made drapes.

Machine 10 includes a frame constructed of a base 11 including a base 12 and feet 13 and 14 at the opposite ends of brace 12 and extending laterally thereof. Base 11 supports a pair of spaced vertical rails 16 and 17 which together with a header 18 define an upstanding frame for supporting the drapery. Reference should be made to U.S. Pat. No. 3,806,606 for a complete understanding of a suitable framework.

A hanger bar assembly 23 is provided in the form of an elongated hanger bar which may have rollers 26 and 27 at each end cooperating with vertically extending hanger bar channel guides 28 and 29. Channel guides 28 and 29 are here mounted on the inside or confronting faces of rails 16 and 17 and extend vertically therewith. Rollers 26 and 27 carried at each end of hanger bar 24, and channel guides 28 and 29 receiving the rollers serve as means by which hanger bar assembly 23 is vertically slidable or movable on the upstanding frame of machine 10. Although channel guides 28 and 29 may extend along the full height of rails 16 and 17, these guides are here disposed only along the upper portions of the frame and terminate at lower ends 31 and 32 intermediate the frame height.

To releasably hold or support the upper pleated or header portion 30 of the drapery, hanger bar assembly 23 includes a plurality of pins or hooks 33 with the sharpened hook portion thereof sloping upwardly and to the front of machine 10. Each of hooks 33 is in turn carried by a slider (not shown) slidably held in a channel slide (also not shown) mounted longitudinally on hanger bar 24 as discussed in my prior patent for horizontal sliding of sliders 34 and the hooks 35 carried thereby. The channel guide may be secured to hanger bar 24 by any suitable means such as by a bracket (not shown) bolted to bar 24 and to which the channel guide may be affixed by suitable means such as by welding as discussed in my prior patent.

To facilitate the attachment of drapery 15 on hanger bar assembly 23, hooks 33 may be linked by a flexible ribbon or web (not shown) along which sliders are fastened at equal longitudinal intervals. Thus, when the web is stretched to a taut condition, hooks 33 are disposed at a typical or standard longitudinal separation for receiving the header or upper pleated portion of drapery 15. All of the foregoing is disclosed in prior U.S. Pat. No. 3,806,006, the teachings of which are incorporated herein by reference.

In this instance machine 10 is equipped with two separate sets of hooks 33. For the width of drapery 15 as shown here, a first set 41 carries the drapery while a second set 42 is shifted over to one side of hanger bar assembly 23. Of course the number of hook sets can be varied in accordance with the intended use of machine 10.

Hanger bar assembly 23 further includes a manually rotatable drapery release bar assembly 43. By the provision of assembly 43, quick and easy release of the drapery 15 from hooks 33 is possible. Assembly 43 includes an elongate release bar 44 having laterally extending arms 46 and 47 at each end thereof mounted to assembly 23 for spaced parallel rotation of bar 44 relative to the horizontally extending axis of the hanger bar assembly.

The construction and operation of release bar assembly 43 is described in detail in my U.S. Pat. No. 3,806,006, the teachings of which are incorporated herein by reference.

In processing drapery 15 in accordance with the operation of machine 10, it is desirable to vertically raise and lower hanger bar assembly 23 within the machine frame. During such raising and lowering assembly 23 will at times carry the weight of the drapery 15. Accordingly, hanger bar assembly 23 is vertically displaceable by a hoist means here provided by a reversible hoist motor 51 rotatably driving a winch shaft 52 journaled within the hollow portion of header 18. Cables 53 and 54 are wrapped about shaft 52 and depend downwardly therefrom where they are joined to hanger bar assembly 23 as shown in FIG. 1. A motor control switch 56 having and "off" position, a "raise" position and a "lower" position provides manual control over the operation of motor 51 and the raising and lowering of hanger bar assembly 23 by the coiling and uncoiling of cables 53 and 54 on winch shaft 52. Suitable electromechanical limit switches (not shown) may be provided to prevent overrun of assembly 23 by motor 51.

As particularly contemplated in the present invention, an improved pleater bar assembly, generally indicated at 61, serves to comb out the folds of drapery 15 and by virtue of a drapery locking feature to stretch the drapery fabric to a desired length or size. Pleater bar assembly 61 here includes a first or front pleater bar 62 and a second or rear pleater bar 63 (see FIG. 2). Pleater bar 63 is horizontally mounted on a pleater bar carriage means formed of carriers 64 and 66 positioned at opposed ends of the pleater bar 63. Carriers 64 and 66 are each vertically movable along and within vertically extending pleater assembly channel guides 67 and 68 mounted similarly to guides 28 and 29 on the inside or confronting faces of rails 16 and 17. In this instance pleater bar assembly 61 and channel guides 67 and 68 are disposed for vertical reciprocation of the pleater bar assembly between an upper position, as shown in FIG. 1, lying immediately below the lower travel limit of hanger bar assembly 23, i.e, adjacent ends 31 and 32 of guides 28 and 29, and a lower position adjacent base 11 of the machine frame.

Figure 2:
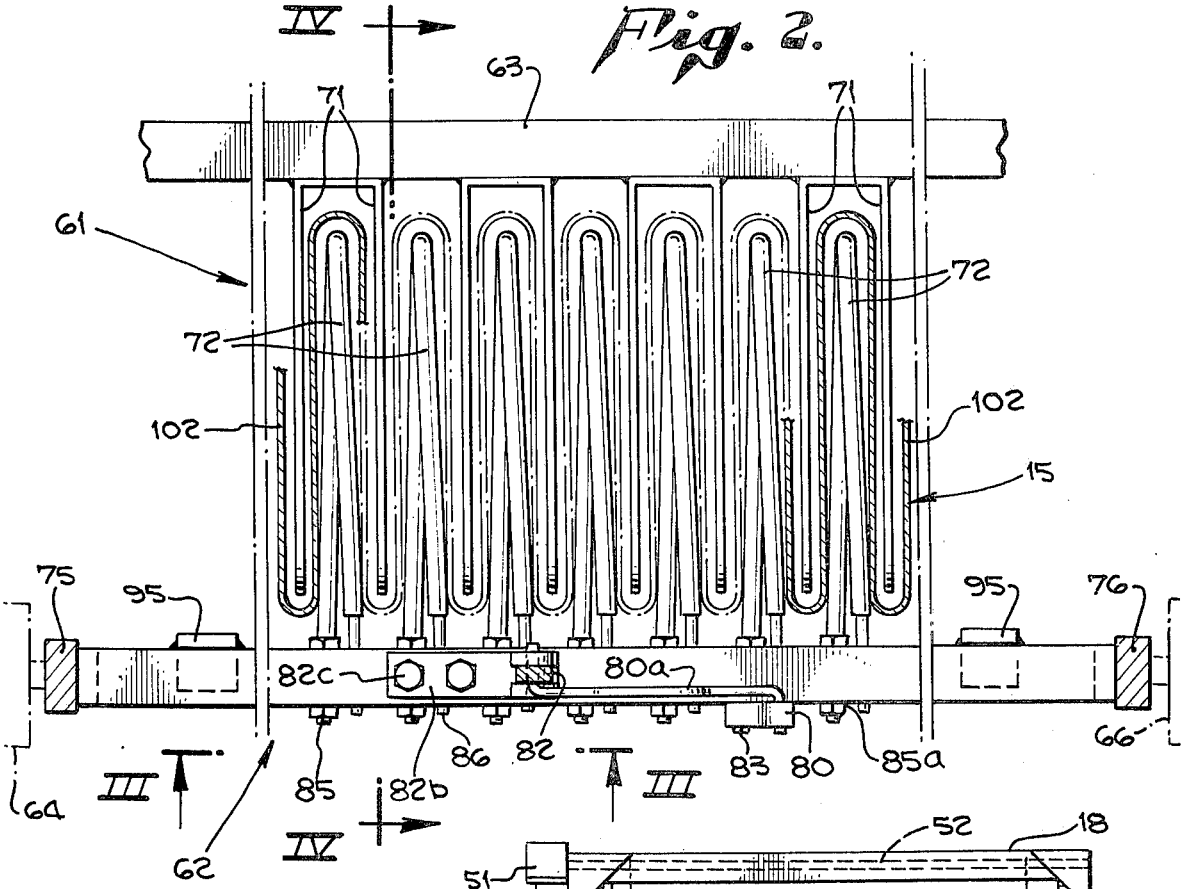
FIG. 2 is a detailed view of the pleater bar assembly alone of the machine of FIG. 1 taken along lines II—II thereof.

Pleater bar 63 is provided with a plurality of generally U-shaped members forming a plurality of outwardly extending spaced plates or pleating fingers 71 (see FIG. 2) mounted at spaced, longitudinal points along bar 63. Pleater bar 62 is provided with a plurality of generally U-shaped wire loops forming pleating fingers 72 (see FIG. 2). The pleating fingers on one of the bars are spaced alternately relative to the fingers on the complementary bar such that the pleater bars may be disposed as shown in FIG. 2, with the various fingers interdigitated or interleaved for combing the drapery folds.

Pleater bar 63 is stationary and thus fixed to carriers 64 and 66 for movement along guides 67 and 68 while retaining its generally horizontal orientation. Pleater bar 62, however, is comprised of upper and lower rail members 73, 74, the upper rail member 73 being fixed at opposite ends to braces 75, 76 (see also FIG. 4) the free ends thereof being pivotally connected via pivot pins 77, 78 to braces 79 (only one shown in FIG. 4) fixed to channel guides 67, 68, respectively. In this manner, as will be discussed, pleater bar 62 is swingable from the position shown in FIG. 2 (and the solid line position of FIG. 4) to the dotted line position shown in FIG. 4. Thus, rear pleater bar 62 is constructed and rotatably arranged to facilitate the relative placement of its fingers 71 with respect to the pleats and folds of drapery 15. It will be observed that the pleating fingers of the pleater bar assembly must be properly positioned with respect to the drapery pleats so as to comb out the original material folds. In other words, a dry cleaned fabric will retain some of its original folds, and the finishing machine should not attempt to alter the position of these folds but should merely straighten or comb them out. Pleater bar 62 by its construction and operation automatically provides for the proper positioning of its pleating fingers.

Figure 4:
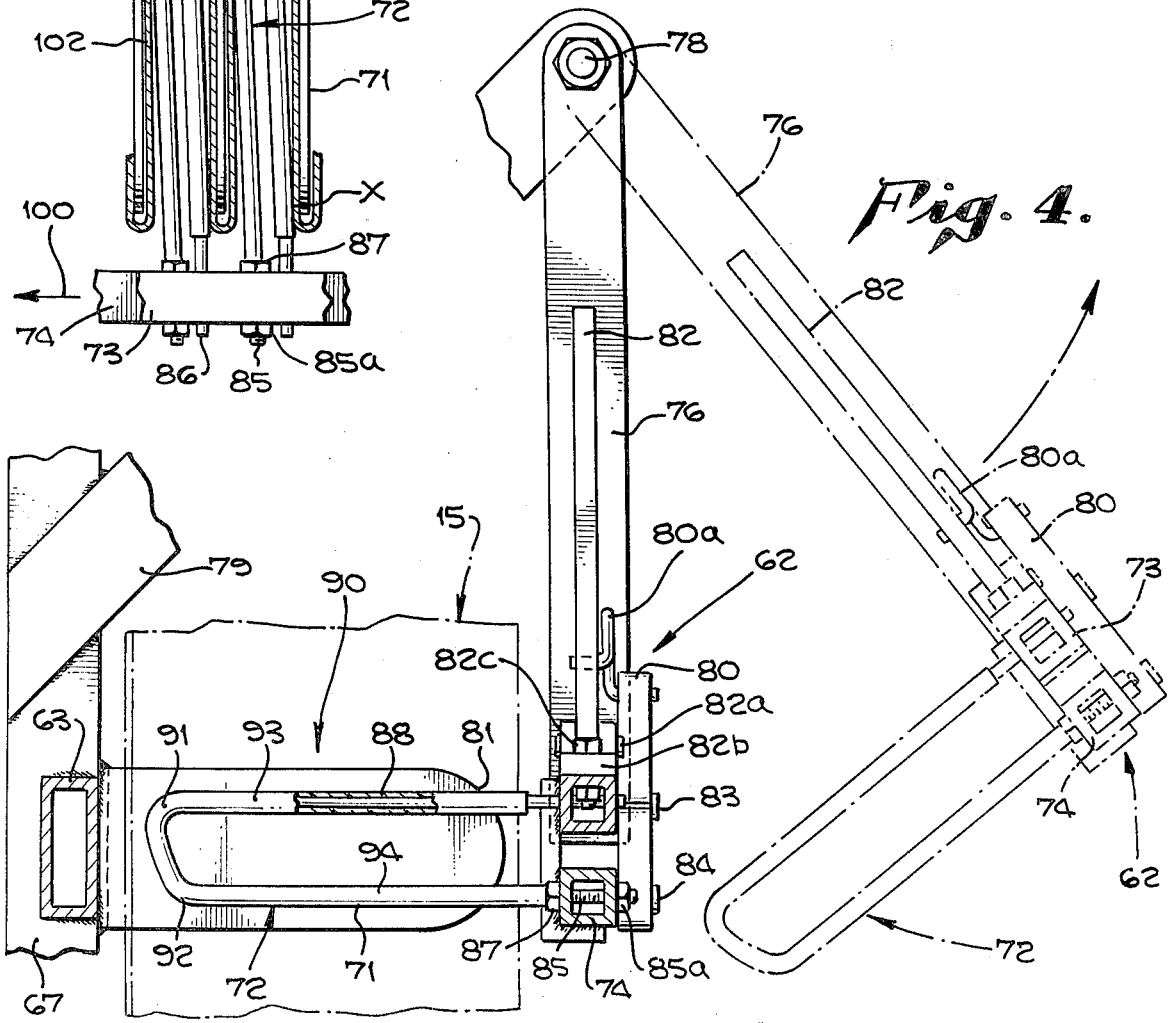
FIG. 4 is a view of the pleater bar assembly of FIG. 2 taken along lines IV—IV thereof and showing, in dotted lines, the movement of the actuating lever thereof.

Bar 63 is stationary with its fingers 71 extending horizontally and forwardly of machine 10 as shown in FIGS. 2, 4, 5 and 6. Fingers 71 are relatively flat plates and may be smooth surfaced or roughened with preferably rounded front edges 81 (FIG. 4).

Front pleater bar 62, as discussed, is comprised of upper and lower rail members 73, 74 interconnected at substantially their centers thereof by a handle 82 (see particularly FIG. 3) which is pivotally connected to the upper surface of rail member 73 by a pivot pin 82*a*. A link 80 is pivotally connected via pivot pins 83, 84 to members 73, 74, respectively. A linking member 80*a*, such as spring steel, configured as shown, interconnects link 80 to handle 82. Pivot pin 82*a* is rotatably mounted in a U-shaped channel member 82*b* secured to upper rail member 73 by suitable bolts 82*c*. Thus handle 82 is movable or pivotable about pin 82*a* to either the left or right in FIG. 3 (as indicated by the arrows) and able to swing 180° in either direction and lock overcenter in both directions generally parallel to pleater bar 62. The steel spring rod or wire 80*a* allows or compensates for differences in drapery thickness. The purpose of handle 82 will be discussed shortly. Fingers 72, on the other hand, are generally U-shaped wire loops as shown in FIG. 4. Each loop 72 terminates in a threaded end 85 and a smooth end 86. A nut 87 or the like may be threaded in each end 85 abutting against a resilient sleeve 88 of smooth surfaces plastic or the like encircling each loop 72 between nut 87 and smooth end 86. Ends 85 and 86 are adapted to be inserted into generally vertically aligned apertures on rail members 73, 74 with a suitable nut 85*a* threaded on end 85 to retain loops 72 in fixed position, the plane thereof extending generally parallel to the plane of each plate or finger 71 (see FIG. 2). As previously discussed, pleater bar 62 is provided with a horizontally extending pivotal axis at pivot 78 disposed forwardly and vertically above the longitudinal axis of bar 63 (FIG. 4). Bar 62 is pivoted about this axis by lateral arms or braces 75, 76 which dispose the longitudinal axis of bar 62 in spaced parallellism with its pivotal axis (solid line position in FIG. 4). Fingers 72 of bar 62 are mounted so that they mesh or interdigitate with fingers 71 of bar 63 when front pleater bar 62 is swung downwardly by gravity into the combing position as shown in FIG. 4. During hanging of drapery 15 on hanger bar assembly 23, front pleater bar 62 may be swung upwardly to an out-of-the-way or retracted position shown in the dotted line position of FIG. 4.

Figure 6:
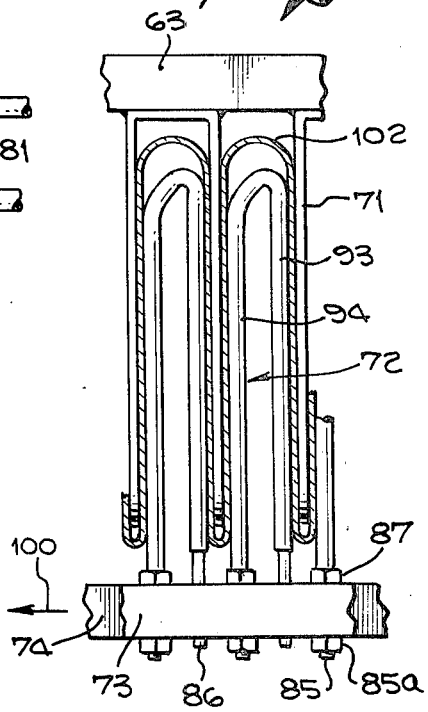
FIGS. 5 and 6 are plan views, partly in section, of a portion of the pleater bar assembly of FIG. 2 illustrating the movement of the pleating fingers thereof.
Figure 5:
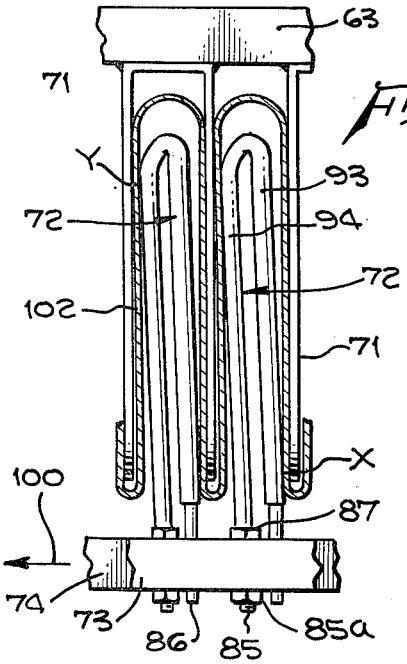

After drapery 15 has been properly hung with rear pleater bar 63 automatically positioning fingers 71 relative to the pleats and folds of the fabric, then front pleater bar 62 may be rotated to the combing position with its fingers 72 interdigitated with fingers 71 and with the folds of the fabric interleaved therebetween as best shown in FIGS. 2, 5 and 6.

During this combing action, assembly 61 may be vertically displaced on the machine frame. For this purpose each of carriers 64 and 66 forming the pleater bar assembly carriage means may be provided with a plurality of roolers, such as the rollers 91, 92 and the related structure discussed in Col. 8, lines 10 et seq. of U.S. Pat. No. 3,806,006, the teachings of which are incorporated herein by reference. Such means provides for smooth vertical reciprocation of the pleater bar assembly.

Movement of pleater bar assembly 61 may be motorized or, as in the present case, manually moved by merely grasping and raising or lowering the assembly on its carriage tracks. This manual displacement may be assisted, as in my patent, by a counterweight (not shown) vertically reciprocating within rail 17 and attached to the pleater bar assembly 61 by a cable as shown in FIG. 1 as discussed in my prior patent.

In addition to the drapery combing function of pleater bar assembly 61, this assembly also includes means for clamping or locking a lower hem portion 102 (FIG. 2) of drapery 15 for the purpose of stretching the fabric to a desired size or length. One such means is disclosed in my U.S. Pat. No. 3,806,006 at Column 8, lines 34 et seq. However, in the instant embodiment, as particularly contemplated in the present invention, such clamping means includes the combination of the aforementioned fingers 71, 72 and the configuration thereof, along with means for clamping or locking drapery fabric between fingers 71, 72 as will be discussed. Thus, in the exemplary embodiment, each finger 72 has an outer curved portion with a greater radius of curvature at the bottom than at the top (see FIG. 4 wherein finger 72 curves at points 91, 92, point 92 having the greater radius of curvature). Further, as shown in FIGS. 4 and 5, clamping means 90 includes means for preventing bulging of the drapery fabric when clamped between fingers 71, 72. Such means includes the U-shaped flexible fingers 72 having flexible coverings 88 and being bent along its plane so that legs 93, 94 are parallel but do not lie in the same plane.

Figure 3:
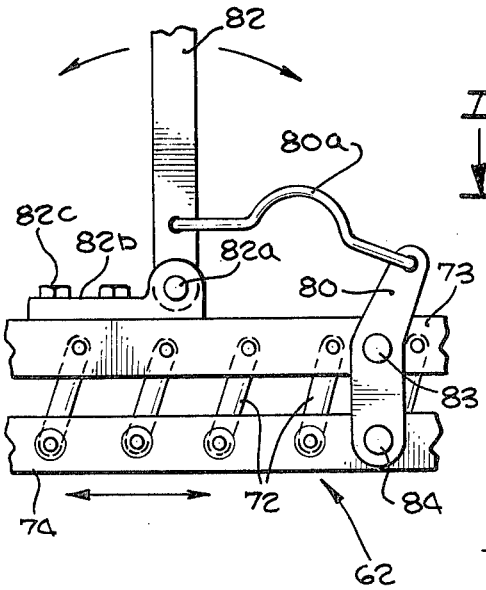
FIG. 3 is a detailed view of the actuating lever of the pleater bar assembly of FIG. 2 taken along lines III—III thereof.

The clamping means further includes locking lever 82 pivotally connected to each rail member 73, 74. The aperture receiving pivot pin 84 in the lower rail member 74 may be elongated or slotted, if desired, as shown in FIG. 3. Guide brackets 95, (FIG. 4) may be provided fixed to respective ends of upper rail member 73 extending downwardly and under lower rail member 74 (but not fixed thereto) to provide guide means for the rail members 73, 74.

The operation of the drapery pleating and finishing machine disclosed and claimed in my U.S. Pat. No. 3,806,006 is identical to that of the instant invention, the teachings of said patent being incorporated herein by reference. However, when it is desired to clamp or lock the drapery fabric between fingers 71, 72, the fabric being positioned as in FIG. 2, and pleating bar 62 swing to the solid line position of FIG. 4, fingers 72 extend between the folds of drape 15. When it is desired to clamp the drapery fabric, lever 82 is rotated to the left in FIG. 3. Fingers 72 engage the sides of fingers 71 as shown in FIG. 5. The initial contact is such that only the rear portion of leg 93 engages the forward portion of finger 71 (at point X in FIG. 5). Due to the inherent resiliency of fingers 71, 72 and the pivoted movement of pleated bar 62, as the fabric 15 is initially clamped, it shifts bar 62 carrying finger 72 outwardly in the direction of arrow 100. The drapery fabric 15 slides about the smooth surfaces of fngers 72 and is then clamped between the forward surface of leg 93 and finger 71, as shown in FIG. 5, at point Y, whereas the overall length of leg 94 comes into progressive contact with the wall of its finger 71. The final clamping position of fabric 15 between each finger 72 and fingers 71 is shown in FIG. 6. Thus, all bulging is eliminated in drapery fabric 15. Lever 82 may then be locked in position to the left in FIG. 3, as previously discussed, and the drapery operations discussed in my U.S. Pat. No. 3,806,006 carried out.

Figure 7:
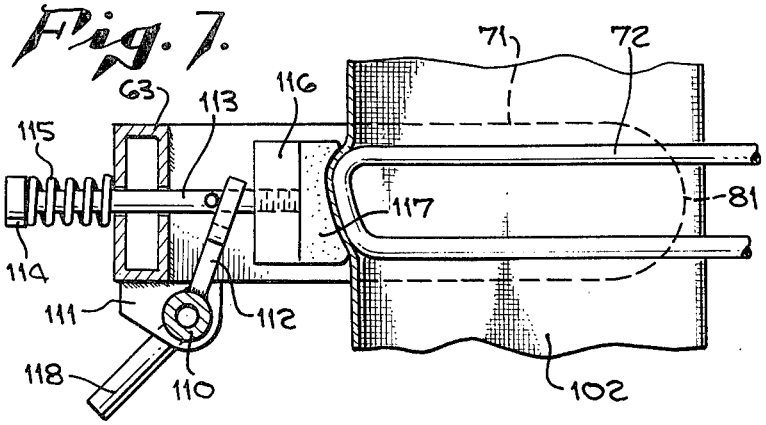
FIG. 7 is a side view, partly in section, showing a modification of the pleater bar assembly of FIG. 2.

Further, it is noted that approximately 90% of the drapery fabric 15 between fingers 71, 72 is gripped in this manner. If desired, means may be provided for clamping approximately the remaining 10% of the drapery fabric. In the exemplary embodiment of the invention, as shown in FIG. 7, such means may include a rail member or tubular 110 fixedly secured to the lower end of pleater bar 63 and extending substantially parallel to and substantially the full length thereof. Tubular member 110 may be rotationally mounted in a flange or bracket 111 fixed to pleater bar 63. A plurality of forks 112 are fixed at spaced locations along member 110 extending upwardly and between the respective fingers 71. A guide rod 113 is fixed to each fork 112 and passes through suitable apertures in pleater bar 63 terminating in an enlarged head 114. A spring 115 encircles rod 113 between head 114 and bar 63 for biasing rod 113 rearwardly or to the right in FIG. 7. A block member 116 is carried at the forward end of each rod 113 and freely movable between fingers 71 (in the space between the bar 63 and the forward end of fingers 72). A suitable resilient member, such as a rubber pad 117, conformed as the forward or curved end of fingers 72, is fixedly secured to each block member 116. An actuating lever 118 is fixed to one end of tubular member 110.

In operation, when the drapery fabric has been positioned and locked or clamped in place, as discussed with respect to FIGS. 5 and 6, lever 118 is actuated to rotate tubular member 110 and thus move forks 112 and rods 113 against the bias of spring 115 to thereby contact the drapery fabric 102 encircling the curved end of fingers 72. Since pad 117 conforms to the curved shape of fingers 72, the drapery fabric is locked or clamped over approximately the total area of fabric interleaving fingers 71, 72.

I claim:

1. In an apparatus for pleating and stretching draperies in which an upstanding frame carries a horizontally disposed hanger bar for securing an upper end of a drapery, and a pleater bar assembly vertically movable on said frame, said pleater bar assembly including first and second horizontally disposed elongated pleater bars mounted on said carriage means, the second pleater bar having a plurality of longitudinally spaced laterally outwardly extending pleating fingers, said first pleater bar having a plurality of longitudinally spaced laterally outwardly extending inner and outer nested normally coplanar pleating fingers alternately mounted relative to said second pleater bar fingers to assume an interdigitated relationship for combing the drapery therebetween, manually operated means for selectively axially shifting said inner and outer nested pleating fingers of said first pleater bar for clamping the folds of the drapery on both sides of said second pleater bar fingers by the inner and outer fingers of said first pleater bar, whereby a lower hem of the drapery may be neatly and uniformly locked by the fingers of the pleater bars on both sides of each drapery fold, the improvement which comprises:

said first pleater bar including bulge preventing means thereon for initially contacting only the inner area of said drapery at the forward ends of the fingers of said second pleater bar when said manually operated means is actuated to clamp said folds thereby allowing the drapery to shaft about said nested fingers as actuation of said operating means clamps said folds so that the drapery material between said nested fingers conforms to the fingers of said first pleater bar in the back portion of said drapery fold adjacent the forward ends of the fingers of said second pleater bar before the entire drapery fold is clamped between said nested fingers upon actuation of said operating means to thereby prevent formation of a bulge in said drapery folds between the forward ends of said fingers of said first pleater bar and said second pleater bar when in clamped position.

2. In the improved apparatus of claim 1 wherein said bulge preventing means includes said fingers of said first pleater bar being generally U-shaped resilient members comprised of a pair of longitudinally extending legs with each member bent along its planes so that each leg of each of said U-shaped members is parallel to the other leg thereof but both legs of each member do not lie in the same plane.

3. In the improved apparatus of claim 2 wherein said fingers of said first pleater bar are wire members.

4. In the improved apparatus of claim 2 wherein said U-shaped members are covered by a sleeve of a smooth surfaced resilient material.

5. In the improved apparatus of claim 2 wherein said U-shaped members have a larger radius of curvature at the bottom than at the top thereof where said U-shaped members contact the back portions of said drapery folds.

6. In the improved apparatus of claim 2 wherein said fingers of said second pleater bar are generally flat plates having rounded corners where said fingers of said second pleater bar contact the inner area of said drapery folds.

7. In the improved apparatus of claim 2 wherein said second pleater bar is a stationary bar fixedly mounted on said carriage means and said first pleater bar is movable from a first position whereby said fingers of said first pleater bar are out of interdigitated relationship with respect to the fingers of said second pleater bar to a second position whereby said fingers are in said interdigitated relationship.

8. In the improved apparatus of claim 7 whereby said first pleater bar is pivotable about an axis forward and above the longitudinal axis of said second pleater bar.

9. In the improved apparatus of claim 8 wherein said first pleater bar is comprised of a pair of elongated horizontally extending first pleater bar members, said fingers of said first pleater bar being generally resilient smooth-surfaced U-shaped members, one of said first pleater bar members having one of the legs of each of said U-shaped members fixedly secured therein and the other of said first pleater bar members having the other leg of each of said U-shaped members fixedly secured therein so that each of said U-shaped members lies in a plane generally normal to the axis of said first pleater bar, and said manually operated means including a clamping lever pivotally connected to both said first pleater bar members for laterally shifting one of said first pleater bar members with respect to the other.

10. In the improved apparatus of claim 9 wherein said clamping lever is pivotally connected to both said first pleater bar members at approximately the midpoint thereof.

11. In the improved apparatus of claim 9 wherein said clamping lever is pivotally connected at a points on said first pleater bar members lying in a plane extending generally normal to the longitudinal axis of said first pleater bar when the fingers of said first pleater bar lie in planes extending generally normal to the longitudinal axis of said first pleater bar and lockable in a position generally parallel to said first pleater bar.

12. In the improved apparatus of claim 11 including guide means associated with both said first pleater bar members for guiding said pleater bar members when said first pleater bar members are laterally shifted.

13. In the improved apparatus of claim 1 wherein said bulge preventing means clamps approximately 90% of said drapery folds between said nested fingers.

14. In the improved apparatus of claim 13 further including drapery fold clamping means for clamping approximately the remaining 10% of said drapery folds between said nested fingers.

15. In the improved apparatus of claim 14 wherein said clamping means includes a resilient clamping member disposed in the spacing between each finger of said second pleater bar having a surface conforming to the surface of the forward ends of said fingers of said second pleater bars, and moving means operatively connected to said clamping member for selectively moving said clamping member from a first position out of contact with drapery folds extending about the forward ends of said fingers of said second pleater bar to a second position into clamping engagement therewith thereby clamping approximately the remaining 10% of said drapery folds between said fingers.

16. In the improved apparatus of claim 15 wherein said clamping members are normally resiliently biased toward said first position.

17. In an apparatus for pleating and stretching draperies in which an upstanding frame carries a horizontally disposed hanger bar for securing an upper end of a drapery, and a pleater bar assembly vertically movable on said frame, said pleater bar assembly including first and second horizontally disposed elongated pleater bars mounted on said carriage means, the second pleater bar having a plurality of longitudinally spaced pleater outwardly extending pleating fingers, said first pleater bar having a plurality of longitudinally spaced laterally outwardly extending inner and outer nested normally coplanar pleating fingers alternately mounted relative to said second pleater bar fingers to assume an interdigitated relationship for combing the drapery therebetween, manually operated means for selectively axially shifting said inner and outer nested pleating fingers of said first pleater bar for clamping the folds of the drapery on both sides of said second pleater bar fingers by the inner and outer fingers of said first pleater bar, whereby a lower hem of the drapery may be neatly and uniformly locked by the fingers of the pleater bars on both sides of each drapery fold, the improvement which comprises:

said first pleater bar being comprised of a pair of elongated horizontally extending first pleater bar members, and said manually operated means including a clamping lever pivotally connected to both said first pleater bar members for laterally shifting one of said first pleater bar members with respect to the other.

18. In the improved apparatus of claim 17 wherein said clamping lever is pivotally connected to both said first pleater bar members at approximately the midpoint thereof.

19. In the improved apparatus of claim 18 wherein said clamping lever is pivotally connected at points on said first pleater bar members lying in a plane extending generally normal to the longitudinal axis of said first pleater bar when the fingers of said first pleater bar lie in planes extending generally normal to the longitudinaly axis of said first pleater bar and lockable in a position generally parallel to said first pleater bar.

20. In the improved apparatus of claim 19 including guide means associated with both said first pleater bar members for guiding said pleater bar members when said first pleater bar members are laterally shifted.

21. In the improved apparatus of claim 20 wherein said fingers of said first pleater bar are generally resilient smooth-surfaced U-shaped members, one of said first pleater bar members having one of the legs of each of said U-shaped members fixedly secured therein and the other of said first pleater bar members having the other leg of each of said U-shaped members fixedly secured therein so that each of said U-shaped members lies in a plane generally normal to the axis of said first pleater bar.

22. In the improved apparatus of claim 21 wherein said U-shaped members have a larger radius of curvature at the bottom than at the top thereof.

* * * * *